US006102476A

United States Patent [19]

May et al.

[11] Patent Number: 6,102,476

[45] **Date of Patent: *Aug. 15, 2000**

[54] COMPUTER FURNITURE WITH INTEGRATED COMPUTER

[76] Inventors: Gordon G. May, 2513 Pinot La., Modesto, Calif. 95356; Arden May, 626 Stonehenge Dr., Fairfield, Calif. 94585

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,241

[22] Filed: Mar. 11, 1998

[51] Int. Cl.[7] ..... A47C 7/62

[52] U.S. Cl. ..... 297/217.3; 297/188.19; 297/217.4

[58] Field of Search ..... 297/188.14, 188.19, 297/188.16, 188.01, 217.3, 217.4, 188.04, 170

[56] References Cited

U.S. PATENT DOCUMENTS

| | | | |
|---|---|---|---|
| 607,905 | 7/1898 | Wyngaard | 297/188.07 X |
| 1,914,721 | 2/1931 | Isaif | 297/145 X |
| 4,461,470 | 7/1984 | Astroth et al. | 272/17 |
| 4,880,270 | 11/1989 | Cooper | 297/188 |
| 4,979,777 | 12/1990 | Takada | 297/250 X |
| 5,056,864 | 10/1991 | Cooper | 297/188 X |
| 5,106,153 | 4/1992 | Durling | 297/232 X |
| 5,169,210 | 12/1992 | Fricano | 297/188 X |
| 5,177,616 | 1/1993 | Riday | 358/254 X |
| 5,222,780 | 6/1993 | Reh et al. | 297/194 X |
| 5,275,482 | 1/1994 | Grant | 312/235.9 |
| 5,292,173 | 3/1994 | Lambert | 297/161 X |
| 5,326,104 | 7/1994 | Pease et al. | 273/138 |
| 5,480,213 | 1/1996 | Sproule | 297/232 X |
| 5,489,142 | 2/1996 | Mathieu | 297/327 X |
| 5,612,718 | 3/1997 | Bryan | 345/168 |
| 5,765,911 | 6/1998 | Sorenson | 358/254 X |
| 5,779,305 | 7/1998 | Hocking | 297/217 X |
| 5,848,773 | 12/1998 | Bourassa | 248/298.1 X |
| 5,876,002 | 3/1999 | White et al. | 248/118 X |

FOREIGN PATENT DOCUMENTS

| | | | |
|---|---|---|---|
| 001259088 | 3/1961 | France | 297/217.4 |

OTHER PUBLICATIONS

Eye Street article dated Feb. 5, 1998 about computer chair. 1 sheet.

Web pages on "Ergochair" by Ergo Industries, (1997) Last update May, 1988, Accessed Jan. 1999.

Web pages on "The Back Station" computer recliner by Alien Furniture Technology. 6 sheets. Downloaded Jan. 1999.

*Primary Examiner*—Lynne H. Browne
*Assistant Examiner*—Brian H. Buck
*Attorney, Agent, or Firm*—Jack Lo

[57] ABSTRACT

A furniture with an integrated computer comprises an easy chair with large, thick cushions, and a pair of wide armrests that extend from about waist level to almost the ground. The right armrest is hollow, and serves as the case of a personal computer by housing the circuit boards, power supply, and hard disk drive. A small console at the front of the right armrest houses removable media drives within easy reach. A pad on the right armrest supports a mouse, joystick, or other input device. A monitor support and a keyboard support are mounted on a horizontal arm pivotally attached to the left armrest, and respectively support a monitor and a keyboard. A pair of speakers are mounted on either side of a headrest. A reclining mechanism arranged under the seat enables a backrest to be reclined, and a footrest to be extended by moving a lever on a side of the chair. In a second embodiment, a furniture with an integrated computer comprises a desk with a wide hollow leg housing a personal computer, and a disk drive console pivotally mounted on a desktop. The console is retractable flush into the desktop.

16 Claims, 4 Drawing Sheets

COMPUTER FURNITURE WITH INTEGRATED COMPUTER

BACKGROUND OF THE INVENTION

1. Field of the Invention

This invention relates generally to furniture with an integrated personal computer.

2. Prior Art

A typical personal computer includes a case, a monitor, a keyboard, and a mouse. The case houses several circuit boards, disk drives, a power supply, cable connectors, and switches. The monitor, keyboard, and mouse are usually positioned on a desk, and the case may be positioned on the desk or on the floor under the desk. The desk occupies a lot of space, which may not be available in a small home, and does not conform with the decor of a living room, family room, or den. The chair used with the desk must be a relatively tall and upright office or dining room type chair, so that it cannot be comfortably used for watching television or lounging. Further, sitting on an upright chair in front of a desk does not provide a sense of realism when playing games, particularly flight and driving simulations.

Although various patents show seats with integrated displays or computers, none is particularly suitable for the home environment. U.S. Pat. No. 4,461,470 to Astroth et al. shows a video game booth with a motion base supporting a seat and a game console. It is much too large and cumbersome for home use. U.S. Pat. No. 4,880,270 to Cooper shows a chair with an arm extending forwardly from one side. Platforms on the top end of the arm are provided for supporting a computer monitor and a keyboard. The case must be positioned separately on the ground, which is unattractive in a living room. Further, when the chair needs to be repositioned, the case must be repositioned separately, which is inconvenient. The chair has no arm rests, so that it is uncomfortable. U.S. Pat. No. 5,177,616 to Riday shows an airplane seat with a small monitor on a pivoting arm that enables the monitor to be stowed in the armrest. There is no provision for using the display with a personal computer. U.S. Pat. No. 5,275,482 to Grant shows a computer booth that positions a monitor and a case in front of a separate seat, so that it is too large and cumbersome for home use. U.S. Pat. No. 5,515,078 to Greschler et al. shows a chair on a motion base which moves the chair in response to inputs from a joystick. Again, the computer case is separate from the chair. U.S. Pat. No. 5,612,718 to Bryan shows a chair with a keyboard and mouse pad pivotally mounted on the ends of armrests. It includes no provision for housing a computer.

OBJECTS OF THE INVENTION

Accordingly, objects of the present furniture with integrated computer are:

compactness;

a tidy appearance;

to blend into the decor of a living room, family room, or den;

to be conveniently movable as a single unit;

to be comfortable to use; and to enhance realism when playing games.

Further objects of the present invention will become apparent from a consideration of the drawings and ensuing description.

BRIEF SUMMARY OF THE INVENTION

A furniture with an integrated computer comprises an easy chair with large, thick cushions, and a pair of wide armrests that extend from about waist level to almost the ground. The right armrest is hollow, and serves as the case of a personal computer by housing the circuit boards, power supply, and hard disk drive. A small console at the front of the right armrest houses removable media drives within easy reach. A pad on the right armrest supports a mouse, joystick, or other input device. A monitor support and a keyboard support are mounted on a horizontal arm pivotally attached to the left armrest, and respectively support a monitor and a keyboard. A pair of speakers are mounted on either side of a headrest. A reclining mechanism arranged under the seat enables a backrest to be reclined, and a footrest to be extended by moving a lever on a side of the chair. In a second embodiment, a furniture with an integrated computer comprises a desk with a wide hollow leg housing a personal computer, and a disk drive console pivotally mounted on a desktop. The console is retractable flush into the desktop.

DRAWING REFERENCE NUMERALS

| | |
|---|---|
| 10. Chair | 11. Seat |
| 12. Backrest | 13. Headrest |
| 14. Base | 15. Reclining Mechanism |
| 16. Right Armrest | 17. Left Armrest |
| 18. Circuit Boards | 19. Connector Panel |
| 20. Power Supply | 21. Hard Disk Drive |
| 22. Internal Drive Bay | 23. Fan |
| 24. Port | 25. Telephone Connectors |
| 26. Power Connector | 27. Power Connector |
| 28. Panel | 29. Cables |
| 30. Access Panel | 31. Console |
| 32. External Drive Bay | 33. Panel |
| 34. Removable Media Drive | 35. Removable Media Drive |
| 36. Switch | 37. Switch |
| 38. Pad | 39. Mouse |
| 40. Speaker | 41. Monitor Support |
| 42. Keyboard Support | 43. Arm |
| 44. Monitor | 45. Keyboard |
| 46. Lever | 47. Footrest |
| 48. Desk | 49. Leg |
| 50. Leg | 51. Computer Case |
| 52. Door | 53. Console |
| 54. Opening | 55. Desktop |
| 56. Disk Drive | 57. Disk Drive |
| 58. Switch | 59. Switch |
| 60. Panel | |

DETAILED DESCRIPTION OF THE INVENTION

Figure 1:
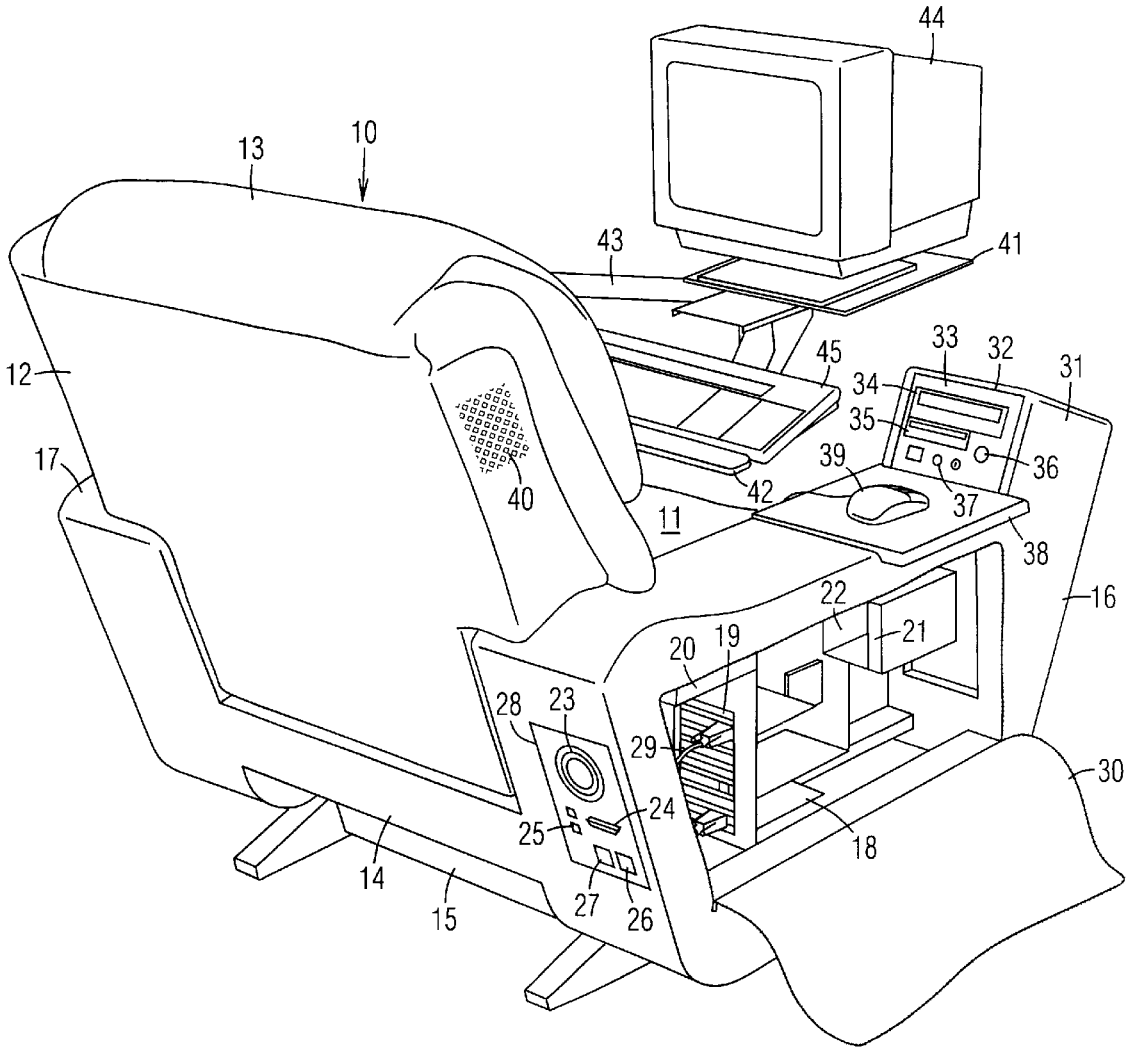
FIG. 1 is a rear perspective view of a first embodiment of the present furniture with integrated computer.

FIG. 1:

A first embodiment of the furniture with integrated computer is shown in the rear perspective view in FIG. 1. It comprises an easy chair 10 with a large, thickly cushioned seat 11, and a large, thickly cushioned backrest 12 with an integral headrest 13. Seat 11 is supported on a base 14, which houses a conventional reclining mechanism 15 well known in the art of easy chairs. A pair of wide, hollow compartments or armrests 16 and 17 are attached to either side of base 14. Each armrest extends between the front of seat 11 and the back of backrest 12, and between a waist position of backrest 12 and the bottom of chair 10. Chair 10 is styled as a conventional easy chair, so that it blends well into the decor of a living room, family room, or den, and is much more comfortable than office or dining room chairs.

Right armrest 16 serves as the case of a personal computer by housing circuit boards 18, a connector panel 19 where the connectors of the expansion boards are located, a power supply 20, and a hard disk drive 21 mounted in an internal drive bay 22. A fan 23, a port 24, a pair of telephone connectors 25, and power connectors 26 and 27 are mounted on a panel 28 on the rear side of armrest 16, and are connected to circuit boards 18 by cables 29. Armrest 16 is large enough to house the relatively large but economical off-the-shelf components. Armrests 16 and 17 are preferably upholstered. Access to the interior of right armrest 16 is provided by a zippered access panel 30, shown opened. A separate computer case is eliminated by integrating the circuit boards, the power supply, and the hard drive into armrest 16, which is a normally necessary part of an easy chair, so that the furniture is compact and tidy. In particular, it is more compact than a desk and office chair combination.

A console 31 is positioned at the front and on top of right armrest 16. A removable external drive bay 32 with a generally vertical control panel 33 is positioned in console 31. Attached to panel 33 are removable media drives 34 and 35, and control switches 36 and 37. Drive bay 32 is removable from console 31 for mounting and wiring drives 34 and 35. A flat pad 38 is positioned on top of right armrest 16 adjacent console 31 for supporting a mouse 39 or any other input device, such as a joystick, a trackball, a telephone, etc. A pair of speakers 40 (one shown) are mounted within the sides of headrest 13. A monitor support 41 and a keyboard support 42 are attached to the distal end of an arm 43, the proximal end of which is pivotally attached to left armrest 17. A monitor 44 and a keyboard 45 are respectively positioned on top of supports 41 and 42. Other input devices, such as a steering wheel (not shown), can be positioned on keyboard support 42. Chair 10 and everything on it can be conveniently moved as a single unit.

Figure 2:
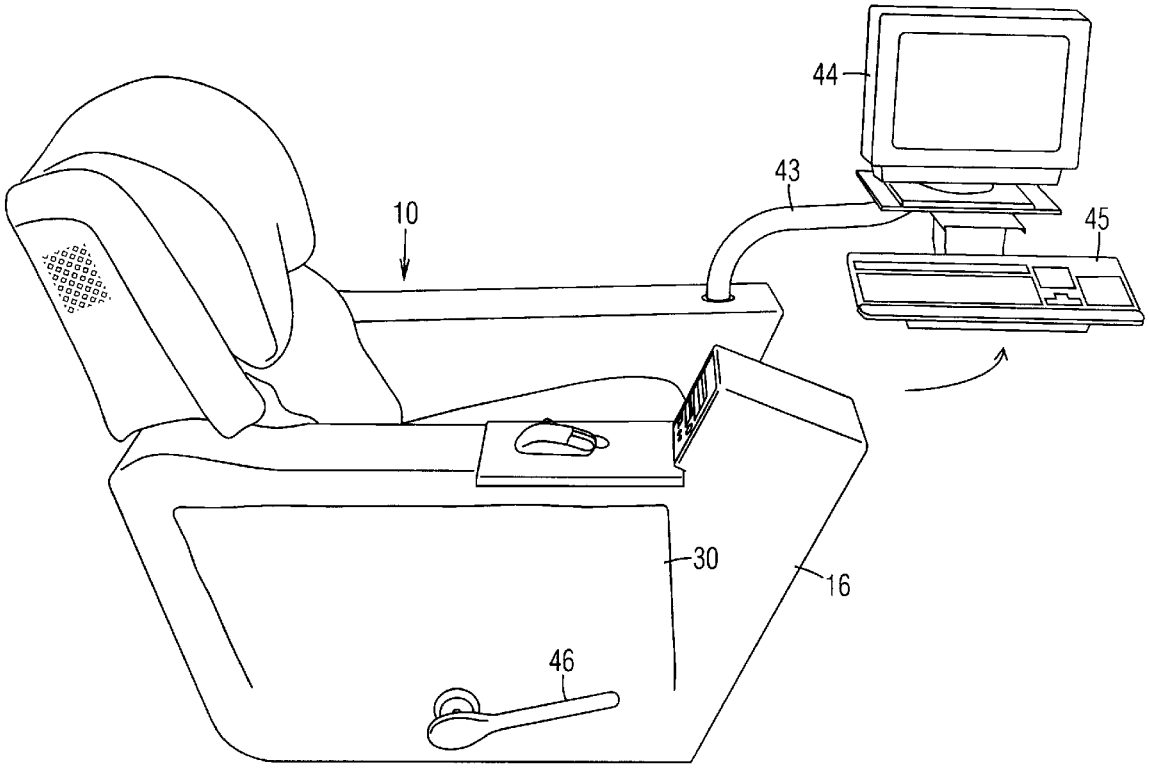
FIG. 2 is a side view of the furniture with integrated computer.
Figure 3:
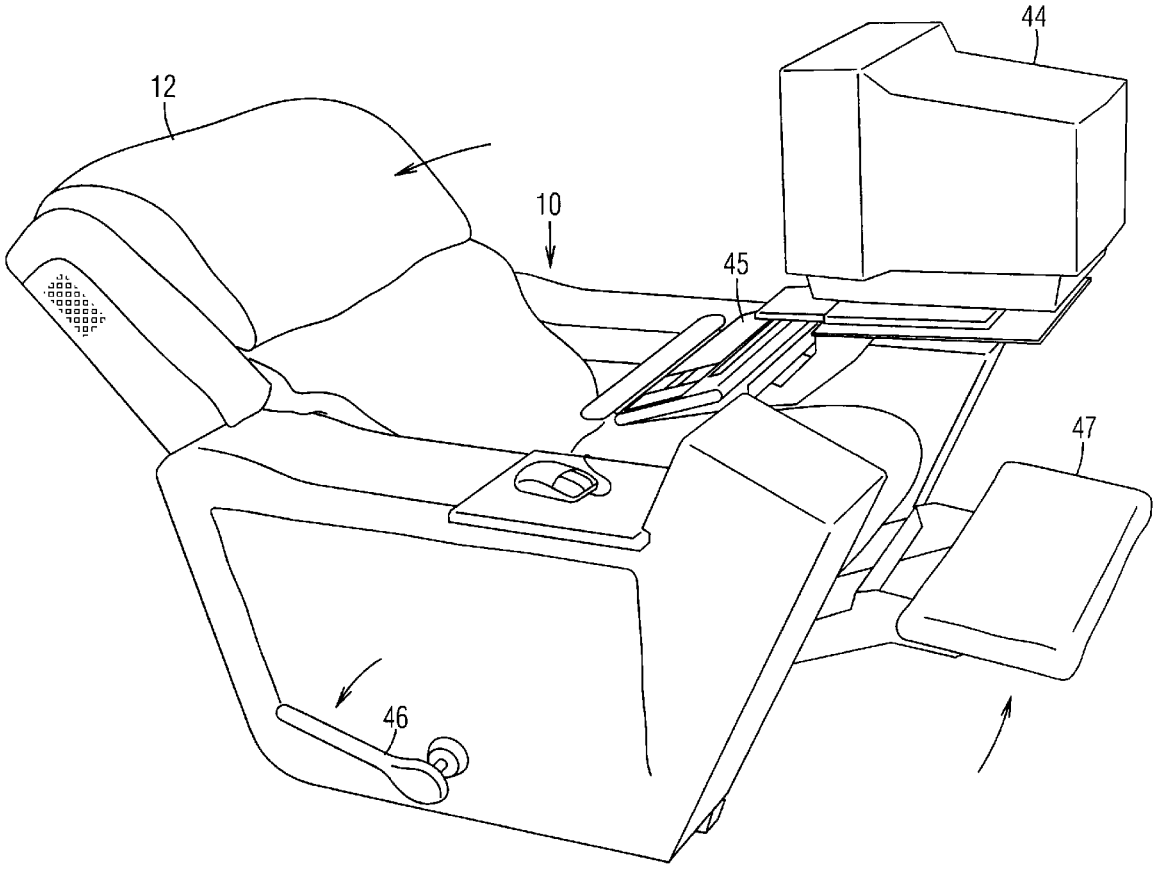
FIG. 3 is a side perspective view of the furniture with integrated computer in a reclined position.

FIGS. 2–3:

Chair 10 is shown in a side view in FIG. 2, with zippered panel 30 closed. Arm 43 is pivoted about a vertical axis, so that monitor 44 and keyboard 45 can be pivoted out and to a side for ingress and egress. A control lever 46 is attached near the bottom of armrest 16, and connected to the reclining mechanism. As shown in FIG. 3, backrest 12 is reclined, and a footrest 47 is extended by moving lever 46. Monitor 44 and keyboard 45 are pivoted to a closed position for use. All the input devices are ergonomically positioned, so that they fall readily at hand for enjoyable and comfortable computer use, such as typing letters or surfing the Internet. Easy chair 10 and the placement of the input devices also provide the feel of a fighter cockpit, a racing car, or other vehicles for enhancing gaming experience. Chair 10 doubles as a conventional easy chair for watching television or lounging when the computer is not in use.

Figure 4:
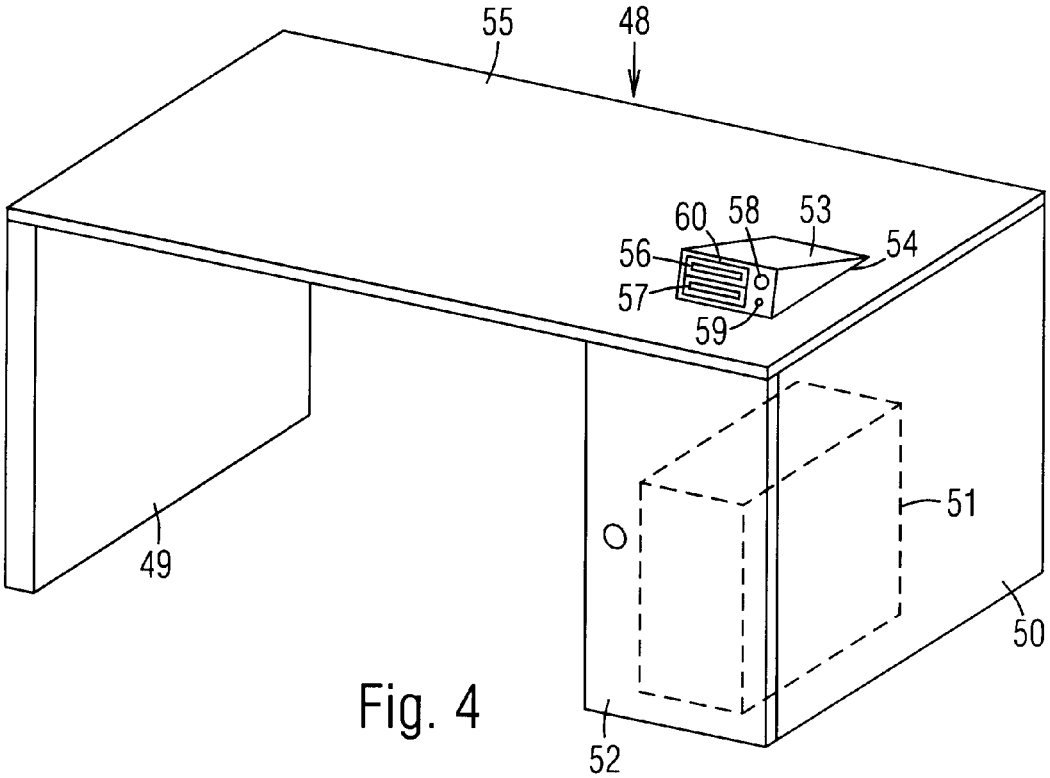
FIG. 4 is a front perspective view of a second embodiment of the furniture with integrated computer.
Figure 5:
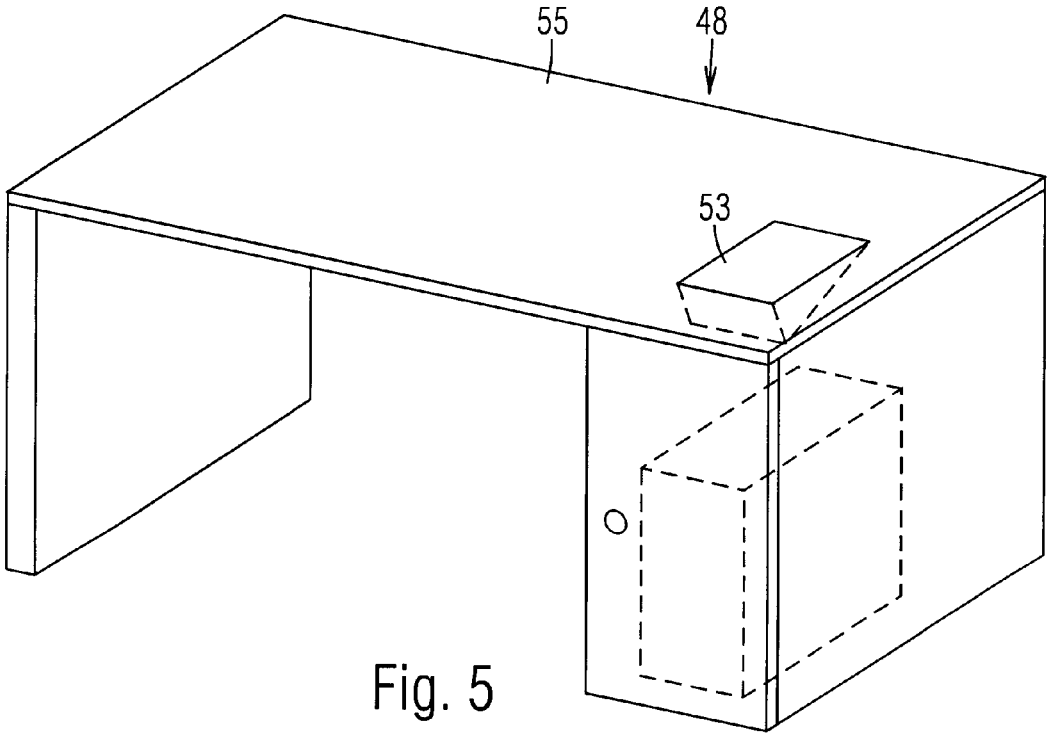
FIG. 5 is a front perspective view of the furniture with integrated computer of FIG. 4 with a disk drive console in a retracted position.

FIGS. 4–5:

As shown in FIG. 4, a second embodiment of the invention comprises a desk 48 with legs 49 and 50. Leg 50 is wide and hollow, and houses a conventional computer case 51 behind a door 52. A console 53 is positioned within an opening 54 on a desktop 55. Removable media disk drives 56 and 57, and control switches 58 and 59 are positioned in a front panel 60 of console 53. The rear of console 53 is pivotally attached to desktop 55, so that console 53 is retractable flush into desktop 55, as shown in FIG. 5.

SUMMARY AND SCOPE

Accordingly, a furniture with an integrated computer has been provided. In the first embodiment, it is compact, tidy, and blends well into the decor of a living room, family room, or den. It can be conveniently moved as a single unit. It is comfortable to use, and it enhances realism when playing games. In the second embodiment, it provides a disk drive console which can be retracted into a desktop when not in use.

Although the above description is specific, it should not be considered as a limitation on the scope of the invention, but only as an example of the preferred embodiment. Many substitutes and variations are possible within the teachings of the invention. For example, the computer can be housed in a compartment in another part of the chair, e.g., under seat 11. An additional mouse pad can be provided on left armrest 17. Arm 43 can be attached to right armrest 16. An adjustable arm can be provided for positioning monitor 44 and keyboard 45 at different heights. The computer components can be arranged in left armrest 17 instead of right armrest 16. Armrest 16 may be adapted for receiving a computer already housed in a conventional case, e.g., a mini-tower. Access panel 30 may be positioned at the back side of armrest 16. Additional jacks and connectors can be provided. The styling of the easy chair can be varied, and other types of living room chairs can be used, including love seats and sofas, in which a plurality of computers and monitors may be attached. Arm 43 may be detachable, so that a conventional television may be connected to the computer, or for converting chair 10 into a plain easy chair. Various peripherals can be connected to the computer, including a printer, and a video camera for video telephone applications. Mouse 39 and keyboard 45 may be wired or wireless. A compartment can be provided in one of the armrests for housing a joystick when it is not in use. Additional supports can be provided, including a writing or document support. A motion mechanism can be added to base 14 for moving chair 10 in response to joystick inputs. Console 31 can be retractable into armrest 16 when not in use. Disk drives 33 and 34 can be attached to arm 43. A massager and a heater can be provided in chair 10. Other accessories can be attached to chair 10, including a drink holder, an end table, and a dedicated word processor. Therefore, the scope of the invention should be determined by the appended claims and their legal equivalents, not by the examples given.

We claim:

1. A computer chair, comprising:

a seat;

a backrest positioned at a rear of said seat; and a pair of armrests positioned on opposite sides of said seat;

a console generally forward of said seat and projecting above one of said armrests for receiving a disk drive and positioning said disk drive within easy reach of a user;

a hollow compartment positioned adjacent said seat and sized for enclosing a conventional personal computer, so that said computer chair is compact and tidy for blending into a home environment; and a monitor arm having one end pivotally attached to one of said armrests, and an opposite end with a horizontal monitor support plate and a keyboard support for respectively supporting a monitor and a keyboard.

2. The computer chair of claim 1, wherein said seat and backrest are thickly cushioned, thus forming an easy chair.

3. The computer chair of claim 1, wherein said hollow compartment is provided in one of said armrests, so that said computer chair is compact and tidy.

4. The computer chair of claim 1, further including a flat mouse pad on top of and longitudinally aligned with one of said armrests for supporting a computer mouse.

5. The computer chair of claim 1, further including a retractable footrest positioned under said seat, and a reclining mechanism reclining said backrest and extending said footrest.

6. The computer chair of claim 1, further including a control switch arranged on a panel on said console.

7. The computer chair of claim 1, wherein said hollow compartment is provided in one of said armrests, so that said computer chair is compact and tidy, and further including an access panel on a side of one of said armrests for providing access to said personal computer.

8. A computer chair, comprising:

a seat;

a backrest positioned at a rear of said seat; and a pair of armrests positioned on opposite sides of said seat;

a console generally forward of said seat and projecting above one of said armrests;

a disk drive received in said console for being within easy reach of a user;

a plurality of personal computer circuit boards received in a hollow compartment in one of said armrests;

another disk drive received in an internal drive bay positioned in said hollow compartment; and a monitor arm having one end pivotally attached to one of said armrests, and an opposite end with a horizontal monitor support plate for supporting a monitor.

9. The computer chair of claim 8, further including a flat mouse pad on top of and longitudinally aligned with one of said armrests for supporting a computer mouse.

10. The computer chair of claim 8, further including a retractable footrest positioned under said seat, and a reclining mechanism reclining said backrest and extending said footrest.

11. The computer chair of claim 8, further including a keyboard support attached to said monitor arm for supporting a keyboard.

12. The computer chair of claim 8, further including a pair of speakers attached to opposite sides of said backrest.

13. The computer chair of claim 8, further including an access panel on a side of said hollow compartment for providing access to said personal computer circuit boards.

14. A computer chair, comprising:

a thickly cushioned seat;

a thickly cushioned backrest positioned at a rear of said seat;

a pair of armrests positioned on opposite sides of said seat, each of said armrests generally extending from a front of said seat to said backrest, and from a waist portion of said backrest to a bottom of said computer chair, one of said armrests comprising a hollow armrest;

a plurality of personal computer circuit boards received in said hollow armrest;

an access panel on a side of said hollow armrest providing access to said personal computer circuit boards;

a flat mouse pad on top of and longitudinally aligned with one of said armrests for supporting a computer mouse;

a console generally forward of said seat and projecting above one of said armrests;

a disk drive received in said console for being within easy reach of a user;

another disk drive received in an internal drive bay positioned in said hollow armrest;

a panel attached to a back side of said hollow armrest, said panel including a fan, a port, a power connector, and a telephone connector;

a monitor arm having one end pivotally attached to one of said armrests;

a horizontal monitor support plate attached to another end of said monitor arm for supporting a monitor; and a keyboard support attached to said another end of said monitor arm for supporting a keyboard.

15. The computer chair of claim 14, further including a retractable footrest positioned under said seat, and a reclining mechanism reclining said backrest and extending said footrest.

16. The computer chair of claim 14, further including a pair of speakers attached to opposite sides of said backrest.

* * * * *